United States Patent [19]

Bollig et al.

[11] Patent Number: 5,031,687

[45] Date of Patent: Jul. 16, 1991

[54] DEVICE FOR STRAIGHTENING A CURVED CAST STEEL STRAND

[75] Inventors: Georg Bollig, Krefeld; Walter Maschlanka, Gaggenau; Hanns Feichtner, Duesseldorf, all of Fed. Rep. of Germany

[73] Assignee: Deutsche Voest-Alpine Industrieanlagenbau GmbH, Dusseldorf, Fed. Rep. of Germany

[21] Appl. No.: 193,889

[22] Filed: May 13, 1988

[30] Foreign Application Priority Data

May 16, 1987 [DE] Fed. Rep. of Germany ..... 3716510

[51] Int. Cl.[5] ..... B22D 11/00; B22D 11/12

[52] U.S. Cl. ..... 164/442; 164/417; 164/476

[58] Field of Search ..... 164/441, 442, 484, 417, 164/413, 476

[56] References Cited

U.S. PATENT DOCUMENTS 3,324,931 6/1967 Bungeroth et al. ..... 164/442

FOREIGN PATENT DOCUMENTS 59-118257 7/1984 Japan ..... 164/442

*Primary Examiner*—Kuang Y. Lin

*Attorney, Agent, or Firm*—Locke Reynolds

[57] ABSTRACT

A device is described for straightening a curved steel strand cast continuously by means of a casting wheel machine or a curved mold continuously casting machine. The strand is passed between straightening points with rolls, such as straightening, bending, guide, counter rolls and/or corresponding roll pairs, in accordance with a certain physical law, whereby at least two roll pairs applying bending moments to the strand are provided. The first roll pair is at the same time the roll pair located in the direction of travel of the strand directly downstream of the point of emergence of the strand from the casting machine or is formed by the casting wheel (of the curved mold) itself and a corresponding straightening roll. The second roll pair determines transition of the strand from a finite radius or curvature to a straight line (infinite radius of curvature) at the end of the bending zone. Between these two roll pairs other rolls can be located exclusively along the outside of the strand.

2 Claims, 4 Drawing Sheets

DEVICE FOR STRAIGHTENING A CURVED CAST STEEL STRAND

BACKGROUND OF THE INVENTION

The invention concerns a device for straightening a curved steel strand cast continuously by means of a casting wheel machine or a curved mold continuous casting machine. The invention particularly concerns such a device where the strand is passed between rolls such as straightening- bending- guide- or counter-rolls and/or roll pairs to provide a bending moment to the strand.

The shaping of solids, their deformation, and thus their bending behavior can be predicted with mathematical accuracy only within the range of validity of Hooke's Law. This ideal elastic behavior of a body exists only under conditions where the hysteresis curve of the elastic material evidences an area approaching or in close proximity to zero. Thus, Hooke's Law is valid for elastic solids only in the range of low forces and correspondingly minor deflection.

With increasing deflection in the quasi-elastic range, considerable substitution and boundary conditions, restricted to the case in point, have to be taken into account for mathematically determining the material behavior if one wishes to apply Hooke's Law to an even limited extent. With greater deformation or application of force in the yield region, the physical laws of solids no longer apply. Here, even if only inadequately and again with specification of special boundary conditions, only the knowledge and mathematical combination from fluid continuum physics can be applied. The Plastic region, directly before fracture of the solid, can still only be determined empirically for the practical technical problems which usually occur.

Even less clear are the conditions in continuous casting, especially in curved mold casting, as here bending forces have generally to be applied to a strand of material which can evidence fully elastic properties along its outer solidified skin, while, at least in its inner region, it is still subject to the laws of deformation of fluids, and in the transition zones between solid and fluid behavior also evidences plastic and/or quasi-plastic behavior patterns.

In the case of continuous casting plants with vertical bending configuration, where the strand emerging vertically from the mold is cooled in vertical travel until it has completely solidified, it is still possible to a large extent to calculate the path of the strand and thus the necessary positioning of the bending rolls and straightening rolls to apply relationships from Hooke's Law in this situation, only minor deformation has to be carried out by means of relatively low forces with large bending radii occurring on a strand of material which already possesses largely elastic properties.

Particularly with casting wheels, but also with certain curved molds of small radius, calculation of an ideal curve path within the subsequent bending zone leading up to the straightened steel strand is more difficult. With adequately elastic strand behavior, physical laws are resorted to for calculation of the curve. The curve path is known from the study of the loading of a unilaterally secured beam and also from uniform loading of a beam secured at both ends. In accordance with the two last mentioned boundary cases, conditions are then created for positioning of straightening and bending rolls and, if necessary, corresponding counter rolls which are based extensively on these two mathematical model tests.

Known practice for straightening continuously cast steel from a casting wheel has previously consisted of designing bending and straightening rolls applied at the bending moment based on the model of the unilaterally secured beam.

It is also known to transmit at least two bending moments to a strand emerging from a continuous steel casting plant by means of two rolls pairs positioned at a distance from one another as well as with force-transmitting roll pairs for downward deflection of the emerging strand (DE-AS 23 41 563). This known form of design is distinguished in the area of the bending zone by a number of rolls guiding the strand positively between them, such that the torque imparted to the strand by the roll pairs mentioned cannot lead to free flexure between them. In fact, the positive guidance provided by the number of roll pairs located in between defines a positively prescribed bending curve. This bending curve creates a change in elongation of the strand at the maximum of its crack-free progress beginning and ending at zero, and does not exceed the value of 0.0025%/mm in bending and 0.0030%/mm in straightening.

With all known strand guide systems, straightening is carried out progressively in the bending zone. In a strand guide system, the bending and straightening is carried out on a strand which has a core which is still molten and has a relatively thin strand shell, the radius of curvature being gradually increased in several stages. As in bending and straightening, the progress of change in elongation is important. Elongation can lead to cracks. If empirically determined maximum values are exceeded. The cracking attributable in particular to the fact that with steel in the transition phase form its molten to its solid aggregate state, resistance to a deformation is dependent on the rate of deformation. A mathematical statement is thus possible at least from the point of view of the problem definition.

Seen from the aspect of the possibility of such a mathematical statement of an optimum bending curve, becomes even more intricate if in high temperature ranges above about 1000° C. Additionally, if the solidifying outer skin of the strand has not yet changed in defined manner from a quasi-plastic to a quasi-elastic state, the cast strand cannot be straightened with a small radius. Straightening trains in such high temperature ranges and at so early a state of continuous casting are, for example, to be seen when a casting wheel plant or a continuous casting plant with curved mold is to be operated in direct conjunction with a rolling mill, to minimize energy consumption in the process cycle. For this purpose it is necessary that the temperature of the cast strand be kept as high as possible, but on the other hand, at excessively high temperatures defined processing options can hardly be maintained. The strand material, undefined in respect of its stress behavior, starts in these regions to flow even with minor stress loading and to behave like an incompressible fluid rather than a solid subject to the laws of rigid continuum mechanics.

If the temperature range concerned here one applies customary straightening processes using bending rolls, straightening rolls and counter rolls to a curved cast steel strand, it can be seen that the soft strand material begins to flow perceptibly before reaching the straightening roll set-up to such a degree that it sags visibly in this region thus instead of achieving the desired gradual increases in bending radius pronouncedly curved sections are detectable, even by comparison with even the initial curvature. The previously customary geometrical designs and assumed conditions within a bending zone require improvement, where the bending radius merges tangentially into the outfeed straight line. If the said circular arc is flattened but double flexure unfavorably affecting stress conditions in the strand or even overflexure of the strand is observed before reaching the straightening roll, it is necessary or desirable to deviate from conventional practice to a technical compromise. Additional overflexure will of necessity lead to significant increase in the risk of cracking and thus to reduced quality.

This is where the present invention comes into its own, because it is based on the technical problem of guiding the curved cast strand in a process of the class in question, such that double flexure is prevented, ensuring minimization of the flow rate and of the stresses exerted on the high temperature strand.

SUMMARY OF THE INVENTION

The solution to this problem is achieved by providing a first roll pair at the point of emergence of the strand from the casting operation. The first roll pair operates to transmit a bending moment to the strand and is coupled with a corresponding straightening roll. A second roll pair is positioned at the end of the bending zone for determining the transition of the strand from a finite radius of curvature achieved in the bending zone to a straight line (infinite radius of curvature). Between these two roll pairs, there are other rolls designed exclusively as guide rolls located along the outside of the strand which divide the bending zone into a number (q) of equal sections and provide a bending curve for the strand. The sections begin with Section $A_{n=1}$ immediately after the first roll pair and end with Section $A_{n=q}$ immediately before the second roll pair. The bending curve provided starts from a radius of curvature of $R_m$ in section $A_{n=1}$ and ends with $R=\infty$ in section $A_{n=q}$. In Section $A_{n=n}$, the radius of curvature satisfies the following equation: In addition to the high temperature ranges involved here, the flow rate is practically constant over the entire straightening train and evidences an almost purely plastic behavior during the straightening of the curved cast strand. It is particularly desirable, only and exclusively to exert a bending moment on the strand at the beginning and end of the straightening train, that is to say directly downstream of the exit point of the strand from the casting machine on the one hand, and at the place where the strand changes over from a finite radius of curvature to a straight line. In the straightening train between the two roll pairs applying bending moments to the strand, further guide rolls can be positioned exclusively along the outside of the strand, which for their part do not come in direct frictional engagement with the strand itself.

BRIEF DESCRIPTION OF THE DRAWINGS

The present invention will be explained in further detail with the aid of the accompanying drawings and in particular a design example will be given for a straightening train divided into sections of equal length.

DESCRIPTION OF THE PREFERRED EMBODIMENT

Figure 1:
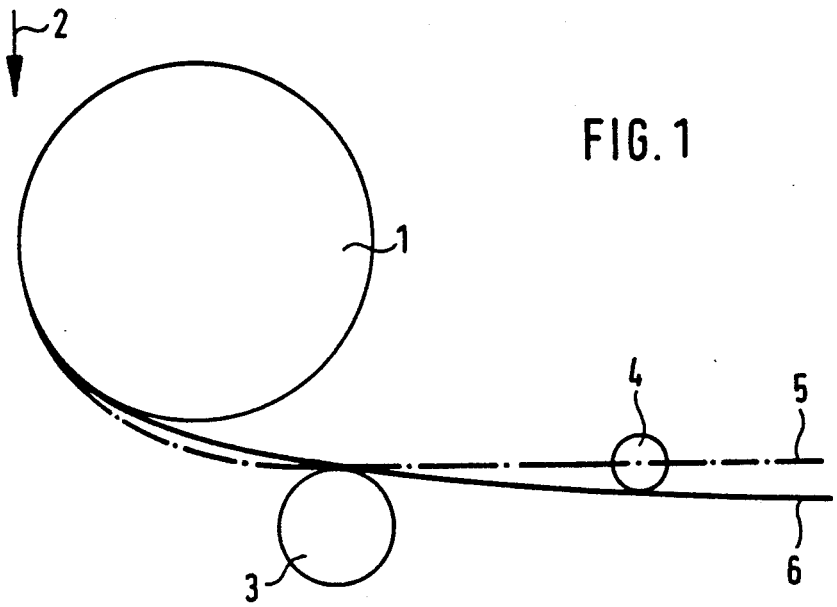
FIG. 1 is a diagrammatic view of a casting wheel with actual and nominal bending characteristic of the straightening train.
Figure 2:
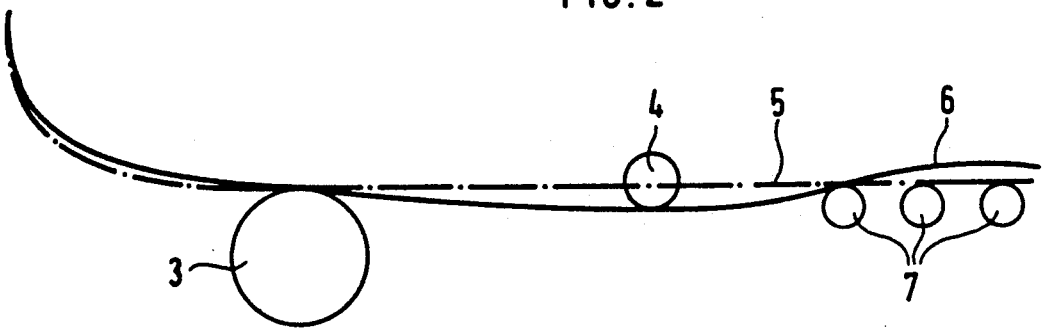
FIG. 2 is a diagrammatic view as per FIG. 1, illustrating the double flexure to be prevented.

The diagrammatic views of FIGS. 1 and 2 illustrate a device for straightening a strand 5, 6, produced by means of a casting wheel 1 by continuous flow of molten steel in the direction of arrow 2. The strand leaving the casting wheel 1 along described line 6 is intended to illustrate the actual path followed between casting wheel 1 here assuming the function of the otherwise customary counter rolls and of the straightening roll 3 on the one hand and of the bending roll 4 on the other hand. In contrast, broken line 5 illustrates the path of a strand if no correction were carried out by means of the straightening, counterpressure and bending rolls. This broken line path 5 is the which as result of the prevalent ferrostatic pressure to the temperatures involved here which would produce plastic behavior.

The ferrostatic pressure and thus the flow of the strand over the entire straightening train leads, to the double flexure of strand 6 as also shown in FIG. 2. This double flexure cannot be corrected by another outfeed roll train 7, without additional cracks in the quasi-solid strand shell occurring as a result of overflexure.

Figure 3:
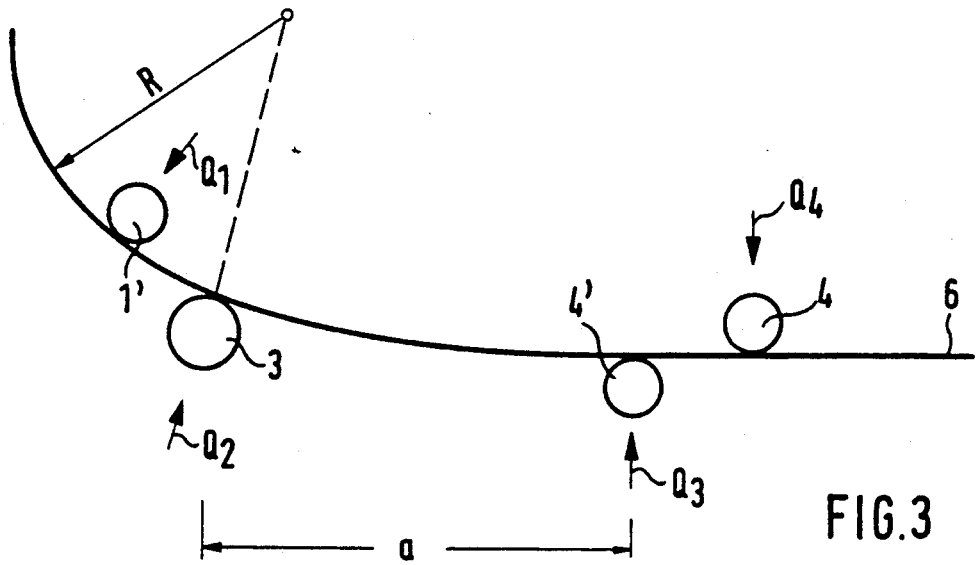
FIGS. 3 and 4 are views for calculation of bending radii with specification of two bending moments (force couples).

FIG. 3 shows in diagrammatic form the bending process used here according to the invention. With the very high temperatures involved here of the strand leaving the casting wheel, the flow rate is a function of the bending stress. A practically constant flow rate results from the constant bending moment between the roll pairs, counter roll 1' ("casting wheel") and straightening roll 3 on the one hand, and the bending roll pair 4,4' on the other hand, due to the force couples $Q_4$, $Q_2$ and $Q_3$, $Q_4$. The length L between the force couples which delimit the bending zone is given here as the length of the straightening train a. Despite the bending moment(s) built up by the force couples in addition to the constant bending stress, the constant flow behavior prevails. This constant flow behavior over length a, as shown diagrammatically in FIG. 4, leads the inner core of the strand to experience constant elongation, the outer core to experience constant compression, while the neutral inner core or fiber experiences neither compression nor elongation along the straightening train.

Figure 4:
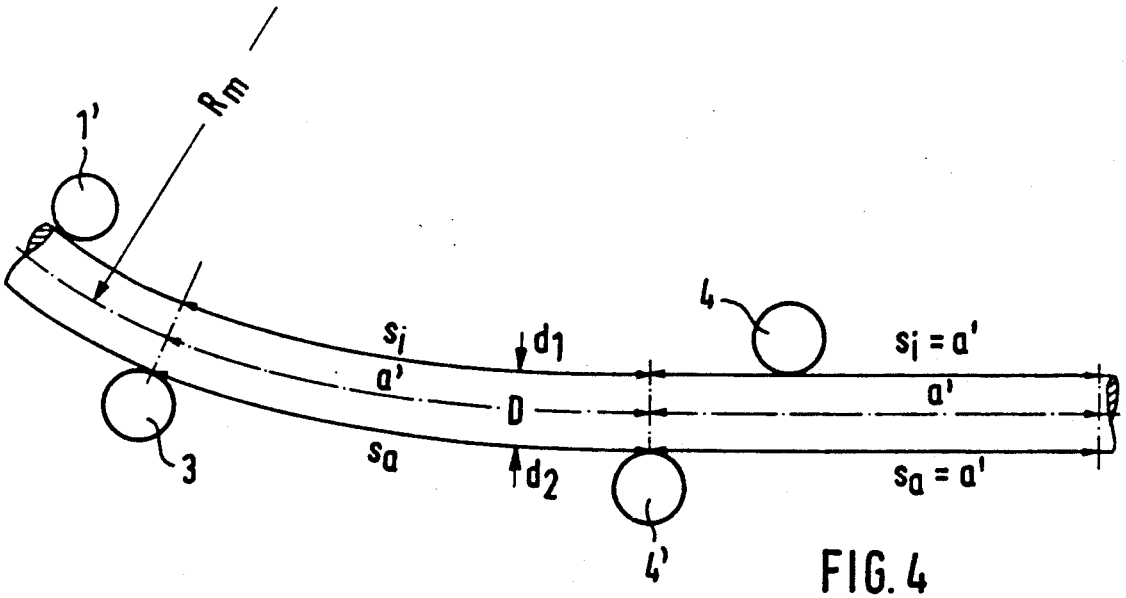

In FIG. 4 the inner core or fiber is designated $s_I$, the outer core or fiber and the neutral fiber a' the casting radius $R_m$ the thickness of the strand between arrows $d_1$ and $d_2$ is D in direction of curvature.

From the elongation constant over the entire length a it is possible to determine at least approximately the deflection curve corresponding to this bending process. When doing so, it is possible to proceed such that first of all the total elongation or compression $\Delta s$ of the inner and outer fibers occurring during straightening is determined from the casting radius Rm and the strand thickness D. This is then, according to the condition of constant flow rate, assigned in q identical subvalues, to q identical part lengths of bending zone a, according to which it is possible to calculate from this allocation the radius at the end of each part length, which in turn permits geometrical step-by-step construction of the deflection curve.

Using the designations provided by FIG. 4, derivation of the equation for determination of the radius at the end of each part length will thus commence as follows:

The inner and outer fiber length before straightening is $$s_{i,a}=a'(R_m \pm D/2)/R_m \qquad \text{I}$$

After straightening, inner fiber length, outer fiber length and centre fiber length are identical $$s_i'=s_o'=a'=a \qquad \text{II}$$

From I and II follows for the inner fiber (and, according to amount, equally for the outer fiber) the total elongation $$\Delta s_i=a-s_i=a-a(R_m \pm D/2)/R_m=a(D/2)/Rm \qquad \text{III}$$

If one now considers individual parts of the bending zone by dividing the length a into q identical sections, designated $A_1, A_2, \ldots A_n, \ldots A_q$, (where $A_n$ designates any part with an integer index between 1 and q), each section $A_n$ will have a length a/q.

If now one also divides the strand within the bending zone into q parts of length a/q and one considers for example the inner fiber of a part, this will be elongated on passing through the complete bending zone by the amount $1/q.\Delta s_i$, but within the section $A_n$ only by the amount.

$$\Delta s_n=1/q.(1/q.\Delta s_i)=\Delta s_i/q^2 \qquad \text{IV}$$

If in this equation one now substitutes the value for $\Delta s_i$ as per III, one obtains $$\Delta s_n=\Delta s_i/q^2=a(D/2)/q^2R_m \qquad \text{V}$$

This is the elongation of the inner fiber of a part on passing through a part length a/q as a function of known selected amounts. This elongation of the inner fiber of a part on passing through a part length can also however be represented as a function of the desired radii at the end of the lengths:

The length of the inner fiber of a part of length a/q before straightening in section An is $$s_{in-1\ 1}=(a/q)(1-(D/2)/R_{n-1}) \qquad \text{VI}$$

and the length of the inner fiber of the same part after straightening in section $A_n$ is $$s_{in}=(/q)(1-(D/2)/R_n) \qquad \text{VII}$$

The elongation $\Delta s_n$ of a part per section is therefore $$\begin{aligned}\Delta s_n &= s_{in}-s_{in-1} \qquad \text{VIII}\\ &= (a/q)[(D/2)/R_{n-1}-(D/2)/R_n]\end{aligned}$$

This relationship can be resolved in terms of $R_n$, that is to say, the radius at the end of a part length $$R_n=R_{n-1}/\{1-[q\Delta s_n R_{n-1}/a(D/2)]\} \qquad \text{IX}$$

If in this equation one now substitutes the value for $\Delta s_n$ in accordance with V, one obtains the following:

$$R_n=R_{n-1}/(1-R_{n-1}/qR_m) \qquad \text{X}$$

That is to say, the relationship sought for the radius at the end of a part length as a function of the casting radius, $R_m$, of the selected number of part lengths, q, and of the radius at the end of the previous part length.

Starting with the casting radius $R_m=R_{n-1}$ for the first part $A_1$, it is possible with this equation for the deflection curve at constant rate of flow for the ends of sections $A_1$ to $A_q$ to calculate the radii of curvature $R_1$ to $R_q$ exactly.

From these radii of curvature the deflection curve can then be apprOximately represented at least graphically. It will be appreciated that accuracy will be greater, the shorter the length of the sections $A_1$ to $A_q$, i.e. the greater q is selected (q must be greater than 1, because for q=1 there is no intermediate value, only the radius of curvature ∞ at the end of the bending zone).

It is worthy of note that in equation X there are no values for elongation, flow rate and strand thickness, that is to say that for a casting radius $R_m$ and a bending zone length a there is only one deflection curve for constant flow rates in the bending zone, this being valid for all casting rates and strand pressures.

Figure 5:
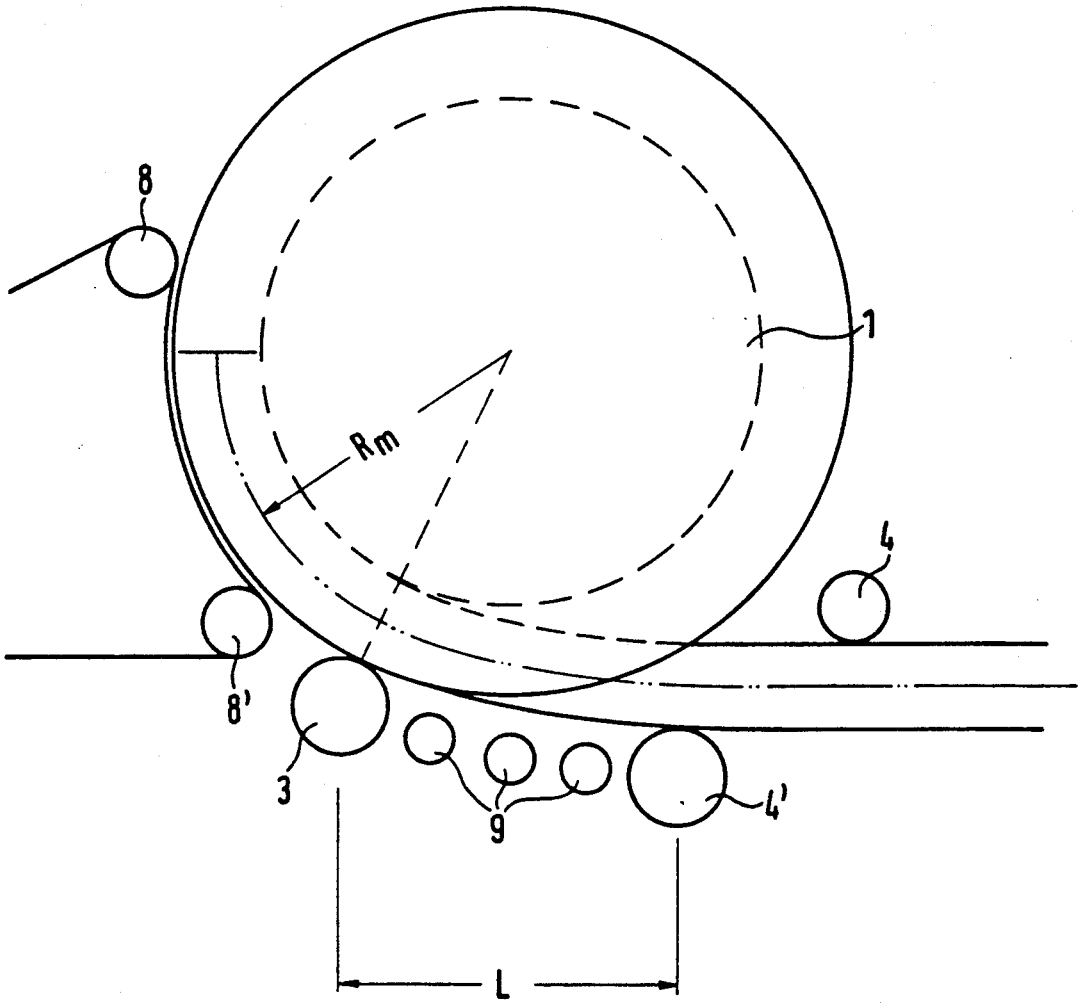
FIG. 5 is another diagrammatic view of the calculation example stated in the description.
Figure 6:
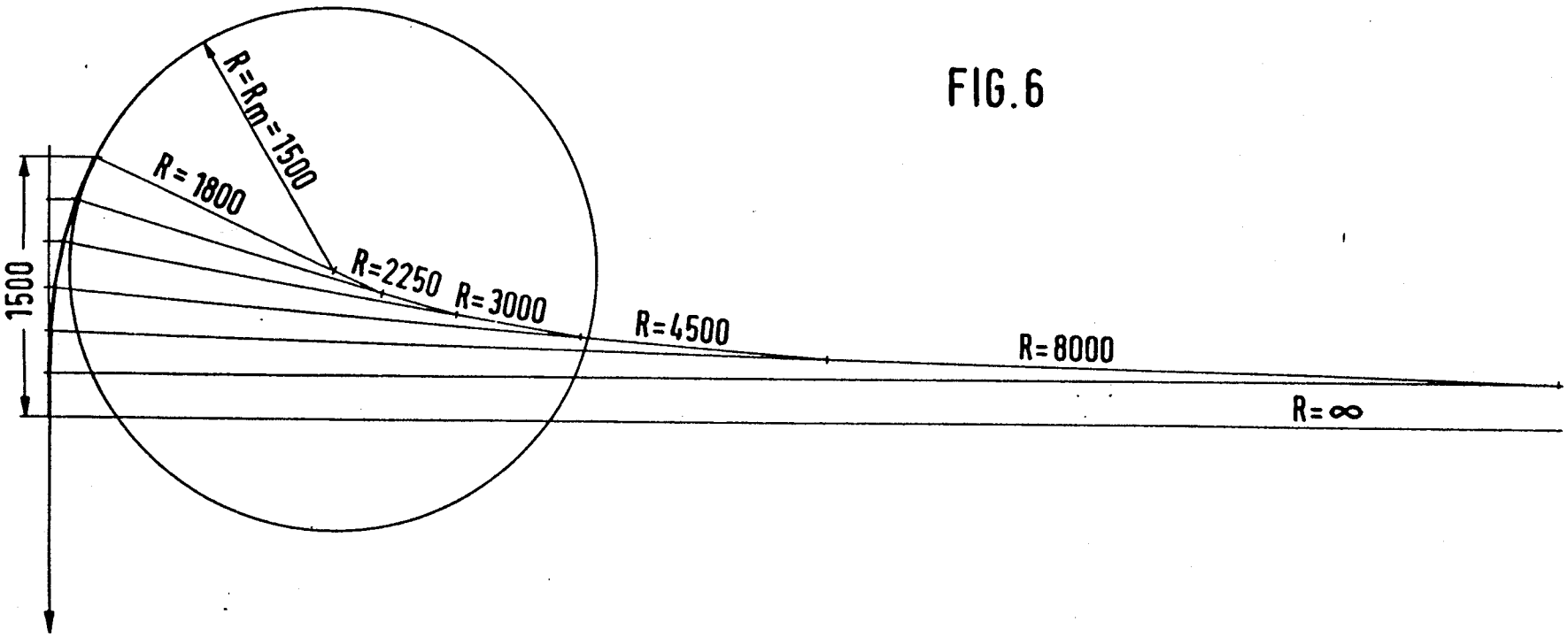
FIG. 6 is a diagrammatic representation of the length of bending radii when the equation is applied to a flywheel with an initial radius of 1500 mm.

As an example of calculation of the radii of curvature of a deflection curve, a casting wheel, as shown in FIG. 5, is chosen with a casting radius of $R_m$ = 1500 mm and a length of the bending zone of a=1500 mm. For calculation of the radii of curvature, the length of the bending zone is divided into q=6 sections; see FIG. 6.

Using equation X the following calculation is then obtained:

$$R_1=\frac{R_m}{1-\frac{R_m}{q\cdot R_m}}=\frac{1500}{1-\frac{1500}{6\times 1500}}=1800\text{ mm}$$

$$R_2=\frac{R_1}{1-\frac{R_1}{q\cdot R_m}}=\frac{1800}{1-\frac{1800}{6\times 1500}}=2250\text{ mm}$$

$$R_3=\frac{R_2}{1-\frac{R_2}{q\cdot R_m}}=\frac{2250}{1-\frac{2250}{6\times 1500}}=3000\text{ mm}$$

$$R_4=\frac{R_3}{1-\frac{R_3}{q\cdot R_m}}=\frac{3000}{1-\frac{3000}{6\times 1500}}=4500\text{ mm}$$

$$R_5=\frac{R_4}{1-\frac{R_4}{q\cdot R_m}}=\frac{4500}{1-\frac{4500}{6\times 1500}}=9000\text{ mm}$$

$$R_6=\frac{R_5}{1-\frac{R_5}{q\cdot R_m}}=\frac{9000}{1-\frac{9000}{6\times 1500}}=\infty$$

If therefore a casting wheel is designed for this bending zone with the geometrical data in accordance with the above equation, the strand will be straightened between roll 2 and roll 3 without any overflexure at constant flow rate. This prevents local stress peaks, as occur when straightening with one or more straightening rolls, which reduces the risk of cracking to a minimum.

What is claimed is:

1. A device for straightening a curved strand cast continuously by a casting machine such as a casting wheel machine or a curved mold continuous casting machine, where the strand is passed between a bow-shaped configuration at the outlet end from the casting machine and a rectilinear configuration, the device comprising:

a first roll pair located directly downstream from the point of emergence of the strand from the casting machine for transmitting a bending moment to the strand, the first roll pair defining the beginning of a bending zone, a second roll pair positioned at the end of the bending zone, the second roll pair determining a transition of the strand from a finite radius of curvature to a straight line ($R=\infty$), and a plurality of guide rolls .situated between the first and second roll pairs, located only along the outside of the strand, dividing the bending zone into equal sections beginning with the Section $A_{n=1}$ after the first roll pair and ending with Section $A_{n=q}$ before the second roll pair), the roll pairs being situated to provide a bending curve for the strand which starts from radius of curvature $R=R_m$ and ending with $R=\infty$, the guide rolls being positioned at the end of each part Section $A_n$ at a radius of curvature which satisfies the equation:

$$R_n=R_{n-}/(1-(R_{n-1}/q.R_m))$$

where $R_m$ is the casting radius of the strand as it emerges from the casting machine, the temperature of the strand in the bending zone being such that the strand shows almost purely plastic behavior at practically constant flow rate throughout the bending zone.

2. The device of claim 1 wherein each radius line $R_n$ passes through the center of curvature of the previous radius line $R_{n-1}$.

* * * * *